US007097247B2

(12) United States Patent
Battey et al.

(10) Patent No.: US 7,097,247 B2
(45) Date of Patent: Aug. 29, 2006

(54) SEATING UNIT WITH ADJUSTABLE LUMBAR DEVICE

(75) Inventors: Robert J Battey, Middleville, MI (US); Eric Johnson, Hudsonville, MI (US); Jonathan B. Hadley, Holland, MI (US); Gordon J. Peterson, Rockford, MI (US)

(73) Assignee: Steelcase Development Corporation, Caledonia, MI (US)

( * ) Notice: Subject to any disclaimer, the term of this patent is extended or adjusted under 35 U.S.C. 154(b) by 206 days.

(21) Appl. No.: 10/846,304

(22) Filed: May 14, 2004

(65) Prior Publication Data

US 2004/0245825 A1 Dec. 9, 2004

Related U.S. Application Data

(63) Continuation-in-part of application No. 10/792,309, filed on Mar. 3, 2004, now Pat. No. 6,932,430, which is a continuation-in-part of application No. 10/455,076, filed on Jun. 5, 2003, now Pat. No. 6,880,886.

(51) Int. Cl.
*A47C 3/025* (2006.01)
*A47C 3/026* (2006.01)

(52) U.S. Cl. ..... 297/284.4; 297/284.7

(58) Field of Classification Search ..... 297/284.2, 297/284.4, 284.7
See application file for complete search history.

(56) References Cited

U.S. PATENT DOCUMENTS

| | | | | |
|---|---|---|---|---|
| 180,548 | A | 8/1876 | Chichester | |
| 567,096 | A | 9/1896 | Harvey et al. | |
| 1,228,771 | A * | 6/1917 | Hanger | 297/284.7 |
| D132,942 | S | 7/1942 | Bargen | |
| D175,802 | S | 10/1955 | Sherman | |
| 2,815,798 | A | 12/1957 | Lohans | |
| 3,241,879 | A | 3/1966 | Castello et al. | |
| D243,128 | S | 1/1977 | Morgan | |
| 4,155,592 | A | 5/1979 | Tsuda et al. | |
| 4,296,965 | A | 10/1981 | Sakurada et al. | |
| D262,326 | S | 12/1981 | Lonnstedt | |
| 4,331,361 | A | 5/1982 | Krakauer | |
| 4,425,910 | A | 1/1984 | Meiller | |
| 4,502,728 | A | 3/1985 | Sheldon et al. | |
| 4,541,670 | A | 9/1985 | Morgenstern et al. | |
| 4,632,454 | A * | 12/1986 | Naert | 297/284.4 |

(Continued)

FOREIGN PATENT DOCUMENTS

| | | |
|---|---|---|
| FR | 2556197 | 6/1985 |

*Primary Examiner*—Rodney B. White
(74) *Attorney, Agent, or Firm*—Price, Heneveld, Cooper, DeWitt & Litton LLP

(57) ABSTRACT

A seating unit includes a back support with a perimeter frame defining an opening, and a plurality of resilient members spanning the opening. An upholstery cover extends over and covers the resilient members and a front of the perimeter frame. A bow-tie-shaped lumbar device is positioned between the cover and sides of the perimeter frame for vertical adjustment. The lumbar device includes a body with end sections defining a greater dimension than a middle of the body. Upper and lower edges of the end sections are thin and serve to wedgingly slip between the cover and the resilient members in a manner leading the middle over irregular surfaces between the resilient members. A thick area between the upper and lower edges causes a change in lumbar support force and shape as the lumbar device is adjusted. Handles are attached to the body by stretchable fabric.

24 Claims, 7 Drawing Sheets

U.S. PATENT DOCUMENTS 4,634,178 A 1/1987 Carney
4,722,569 A 2/1988 Morgenstern et al.
4,925,242 A 5/1990 Harris et al.
5,078,449 A 1/1992 Suzuki
5,101,811 A 4/1992 Brunswick
D336,552 S 6/1993 Timms et al.
5,314,236 A 5/1994 Suzuki et al.
D355,508 S 2/1995 Tutton et al.
5,474,362 A 12/1995 Albecker, III
D366,539 S 1/1996 Lackovic
5,501,507 A 3/1996 Hummitzsch
5,518,294 A * 5/1996 Ligon et al. ..... 297/284.4
5,547,251 A 8/1996 Axelson
5,567,010 A * 10/1996 Sparks ..... 297/284.4
5,651,584 A 7/1997 Chenot et al.
D383,928 S 9/1997 Earleywine, Jr.
5,769,490 A 6/1998 Falzon
5,871,258 A 2/1999 Battey et al.
5,954,399 A 9/1999 Hong
5,967,608 A 10/1999 Van Sickle
5,975,632 A * 11/1999 Ginat ..... 297/284.7
5,975,634 A * 11/1999 Knoblock et al. ... 297/284.7 X
6,059,362 A * 5/2000 Lin ..... 297/284.7 X
6,059,370 A 5/2000 Kanyer et al.
6,079,785 A 6/2000 Peterson et al.
6,220,661 B1 * 4/2001 Peterson ..... 297/218.4
6,354,662 B1 * 3/2002 Su ..... 297/284.7
6,394,545 B1 * 5/2002 Knoblock et al. ..... 297/284.4
6,394,546 B1 * 5/2002 Knoblock et al. ..... 297/284.7
6,402,246 B1 6/2002 Mundell
6,419,318 B1 * 7/2002 Albright ..... 297/284.7
6,471,294 B1 10/2002 Dammermann et al.
6,557,938 B1 5/2003 Long
6,572,190 B1 * 6/2003 Koepke et al. ..... 297/284.7 X
6,575,530 B1 6/2003 Fischer et al.
6,588,842 B1 7/2003 Stumpf et al.
6,595,585 B1 7/2003 Mundell
6,663,177 B1 12/2003 Blanco et al.
6,679,557 B1 1/2004 Craft et al.
6,848,744 B1 * 2/2005 Raftery et al. ..... 297/284.4 X
6,874,852 B1 * 4/2005 Footitt ..... 297/284.4
6,910,741 B1 * 6/2005 Footitt ..... 297/284.4 X
2002/0096920 A1 7/2002 Watson et al.
2002/0163233 A1 11/2002 Craft et al.
2003/0030318 A1 2/2003 Christofferson et al.
2003/0075960 A1 4/2003 Wilkerson et al.
2003/0080595 A1 5/2003 Wilkerson et al.
2003/0085600 A1 5/2003 Mori
2003/0168901 A1 9/2003 Wilkerson et al.
2003/0227203 A1 12/2003 Mundell

* cited by examiner

SEATING UNIT WITH ADJUSTABLE LUMBAR DEVICE

CROSS REFERENCE TO RELATED APPLICATIONS

This application is a continuation-in-part of co-assigned co-invented application Ser. No. 10/792,309, filed Mar. 3, 2004, entitled COMBINED TENSION AND BACK STOP FUNCTION FOR SEATING UNIT now U.S. Pat. No. 6,932,430, which is a continuation-in-part of Ser. No. 10/455,076, filed Jun. 5, 2003, entitled COMBINED TENSION AND BACK STOP FUNCTION FOR SEATING UNIT now U.S. Pat. No. 6,880,886, the entire contents of which are incorporated herein in their entirety.

BACKGROUND

The present invention relates to adjustable lumbar devices for seating units.

Modern chairs and seating units are often provided with adjustable lumbar devices to allow the chair's back to be adjusted for different amounts of lumbar support, as required and desired by different users. However, new lumbar devices are desired that are simpler to manufacture and assemble, and that include less components, lower cost components, and components that function more effectively, and that also provide new visually interesting appearances.

Recently, a new back support was designed having flexible resilient wires extended across an open interior of a perimeter frame. See application Ser. No. 10/792,309, filed Mar. 3, 2004, entitled COMBINED TENSION AND BACK STOP FUNCTION FOR SEATING UNIT, which is incorporated in is entirety by reference. The flexible resilient wires provide excellent ergonomic support to a seated user. However, the wires tend to flex in a manner that reduces the ability of a lumbar panel to slide smoothly up and over each wire during vertical adjustment. A lumbar device is desired that slides more fluidly and smoothly between adjusted positions, yet that is secure in its selected position and effective in its function.

Thus, an improved lumbar device having the aforementioned advantages and solving the aforementioned problems is desired.

SUMMARY OF THE PRESENT INVENTION

In one aspect of the present invention, a seating unit includes a back support, a back cover located on a front surface of the back support but separated from the back support in a lumbar area of the back cover, and a lumbar device adjustably positioned between the back support and the back cover. The lumbar device is selectively moveable to change a shape of the back cover in the lumbar area. The lumbar device includes a unitary sheet with first panel-like wall portions formed to define a first surface and second panel-like wall portions formed to define a second surface. Third wall portions extend between the first and second wall portions to define space therebetween. The first and second wall portions are configured to slidingly engage the front surface of the back support and a rear surface of the back cover, respectively. By this arrangement, vertical movement of the lumbar device causes a shape change of the back cover for providing improved lumbar support to a seated user.

In another aspect of the present invention, a lumbar device is provided for a seating unit, where the seating unit includes a back with a front surface for supporting a seated user. A lumbar device is adjustably positioned on the back for selectively varying a shape of the back in a lumbar area. The lumbar device includes a unitary sheet of generally uniform thickness. The sheet is thermoformed to have first wall portions formed to define a first surface and second wall portions formed to define a second surface. Third wall portions extend between the first and second wall portions to define space therebetween. By this arrangement, vertical movement of the lumbar device causes a shape change of the back for providing improved lumbar support to a seated user. In a narrower form, the thermoformed sheet includes wedged-shaped upper and lower leading edges.

In another aspect of the present invention, a seating unit includes a back support, a back cover, and a lumbar device. The back cover is located on a front surface of the back support but separable therefrom at least in a lumbar area of the back cover. The lumbar device is adjustably positioned between the back support and the back cover. The lumbar device includes a shape-changing member for changing a shape of the lumbar area during vertical adjustment. Handles are provided that track along edges of the back support. Stretchable elastic material connects the handles to respective ends of the shape-changing member. By this arrangement, vertical movement of the lumbar device causes a shape change of the back cover for providing improved lumbar support to a seated user.

In another aspect of the present invention, a seating unit includes a back support, a back cover located on a front surface of the back support but separable therefrom at least in a lumbar area of the back cover, and a lumbar device adjustably positioned between the back support and the back cover. The lumbar device includes a flexible sheet configured to slidingly engage the front surface of the back support and a rear surface of the back cover, respectively. The lumbar device further includes a wire that extends across and supports the flexible sheet, and still further includes handles that track along edges of the back support and yet still further includes stretchable material that connects the handles to respective ends of the wire. Thus, vertical movement of the lumbar device causes a shape change of the back cover for providing improved lumbar support to a seated user.

In another aspect of the present invention, a seating unit includes a back support having side frame members and horizontally extending resilient members defining irregularities in a vertical direction in a lumbar area of the back support. A back cover is provided that is shaped to cover at least a front of the side frame members. A lumbar device is positioned between the back cover and the resilient members for affecting lumbar support. The lumbar deice has a body with end sections connected by a middle section. The end sections have a larger dimension than the middle section and are shaped to guide edges of the middle section over the irregularities as the lumbar device is vertically adjusted.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
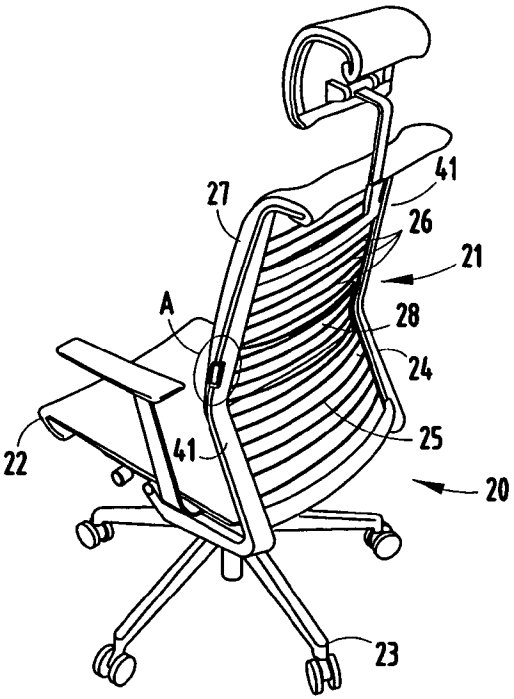
FIG. 1 is a perspective view of a seating unit including a lumbar device embodying the present invention.

A seating unit 20 (FIG. 1) includes a back support 21 and seat 22 supported for synchronous movement by a base 23. The back support 21 includes a perimeter frame 24 defining an opening 25, and includes a plurality of resilient members 26 (i.e. steel wires) spanning the opening and operably supported for flexing for supporting a seated user. An upholstery cover 27 extends over and covers the resilient members 26 and covers a front of the perimeter frame 24. A bow-tie-shaped lumbar device 28 is positioned between the cover 27 and sides of the perimeter frame 24 for vertical adjustment. The lumbar device 28 includes a bow-tie-shaped flexible body 29 with end sections 30 defining a greater vertical dimension D1 than a middle section 31 of the body 29. Upper and lower edges 32 and 33 of the end sections 30 are thin and serve to wedgingly slip between the cover 27 and the resilient members 26 in a manner leading the middle over irregular surfaces between the resilient members 26. A thick middle area between the upper and lower edges 32 and 33 causes a change in lumbar support force and shape as the lumbar device 28 is vertically adjusted. Handles 35 are attached to the body 29 by stretchable fabric loops 36, permitting the handles 35 to track along non-parallel side frame portions of the perimeter frame 24 during lumbar adjustment.

Figure 8:
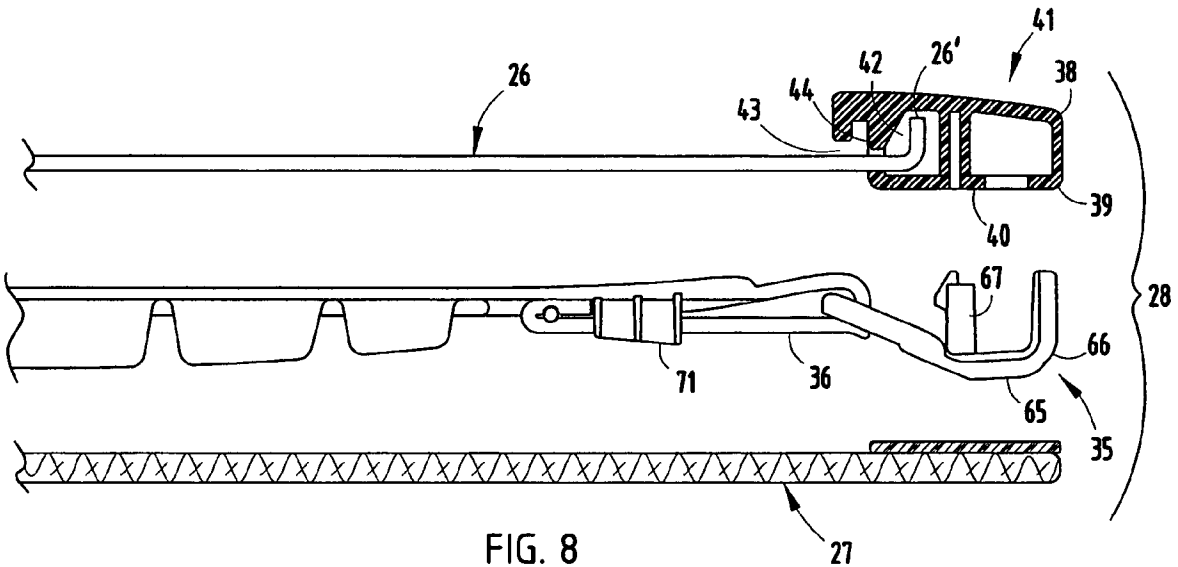
FIG. 8 is an exploded view of FIG. 7.

The perimeter frame 24 (FIG. 8) includes a lower perimeter member 38 and an upper perimeter member 39 attached to the lower perimeter member 38 by screws 40. The lower perimeter member 38 includes side frame sections 41 defining a plurality of pockets 42 that are elongated in a direction toward the opening 25 defined by the perimeter frame 24. The pockets 42 have an access opening 43 that opens across a radiused surface 44 on the lower perimeter member 38. The upper perimeter member 39 covers the access opening 43. The resilient members 26 are steel wires having an L-shaped end 26' positioned in the pockets 42 for sliding movement. The pockets 42 limit inward sliding motion of the resilient members 26. The ends of the resilient members 26 are operably mounted to slide as the resilient members 26 flex, thus providing distributed support for point loads (which is particularly comfortable to a seated user), while eliminating high inward stress on the side frame sections 41 as a middle of the resilient members 26 are rearwardly loaded. The present description is sufficient for a person of ordinary skill to understand the present invention, but it is noted that the details of the function and operation of the perimeter frame 24 and resilient members 26 are described in more detail in the application Ser. No. 10/792,309 incorporated herein by reference above.

The illustrated resilient members 26 are spring steel wires having round cross sections. However, it is contemplated that a scope of the present invention also includes other resilient support members, such as flat springs, non-metal plastic springs, springs made from composite materials, and other resilient support means.

Figure 2:
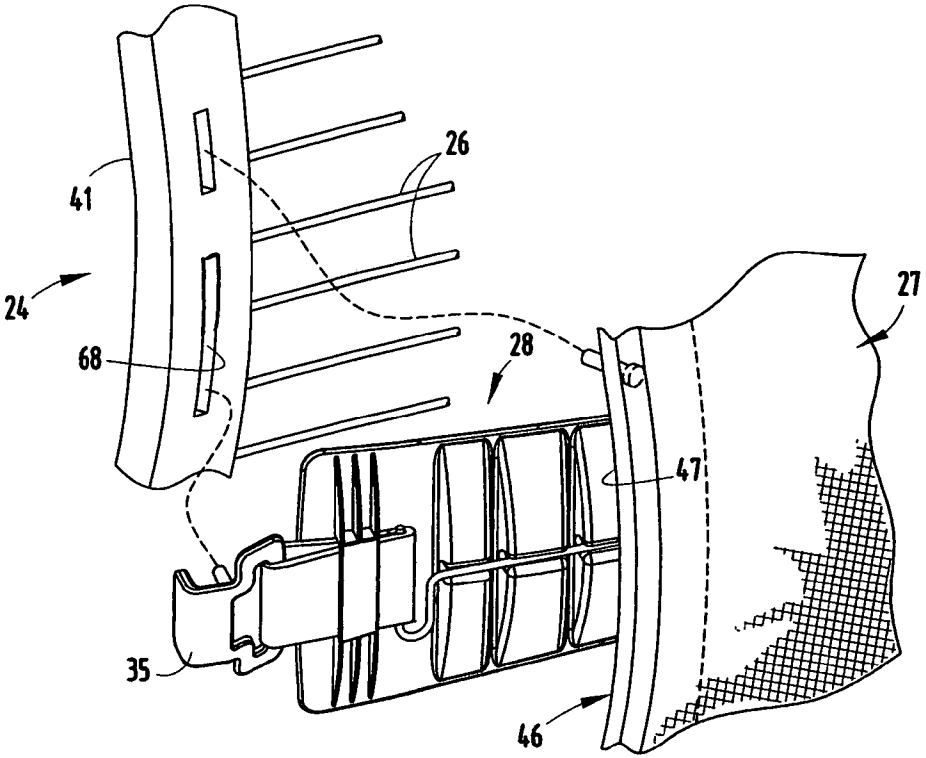
FIG. 2 is a fragmentary exploded view of a circled area "A" in FIG. 1.
Figures 2A, 3:
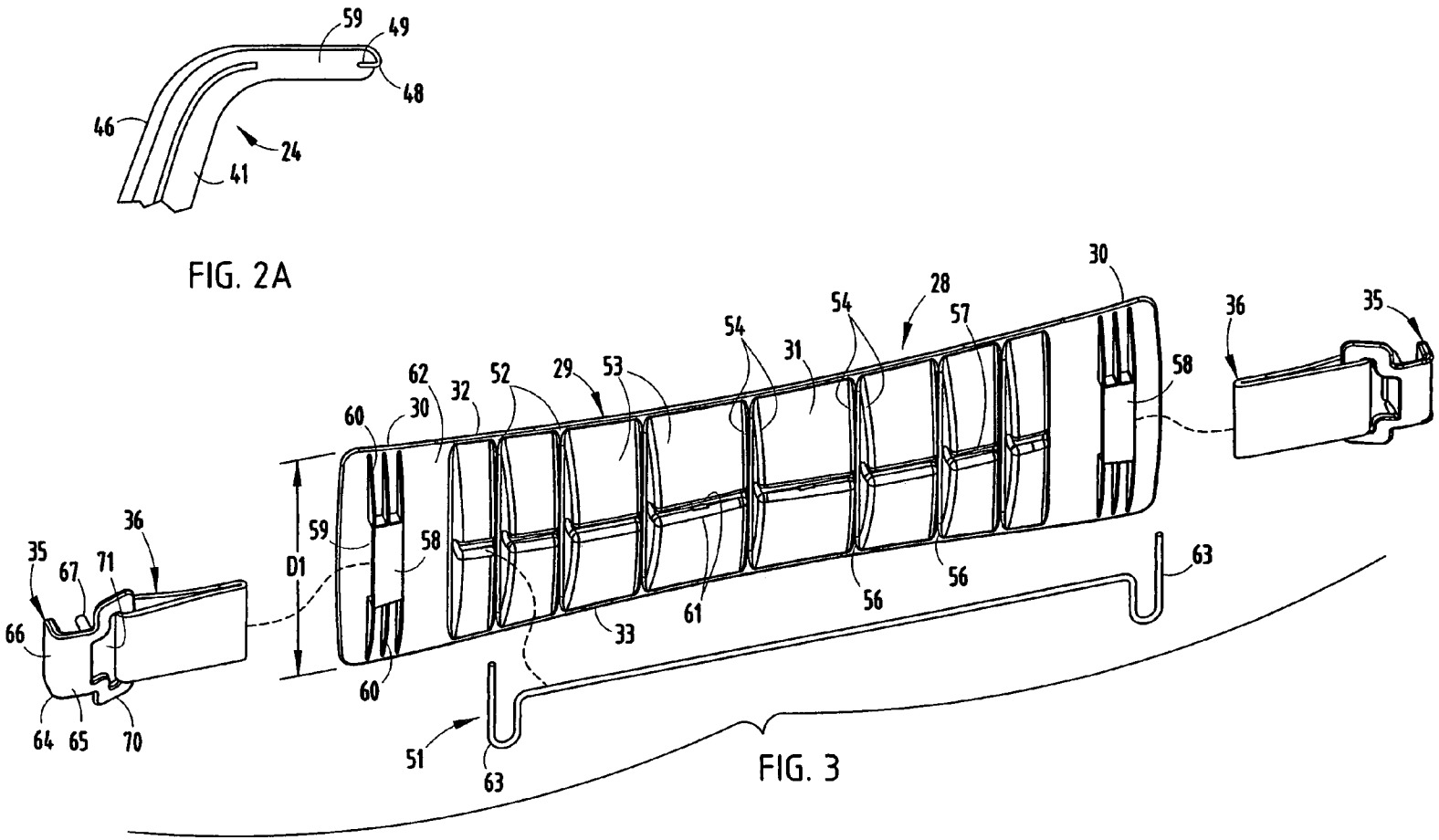
FIG. 3 is an exploded perspective view of the lumbar device shown in FIGS. 1–2.
Figure 4:
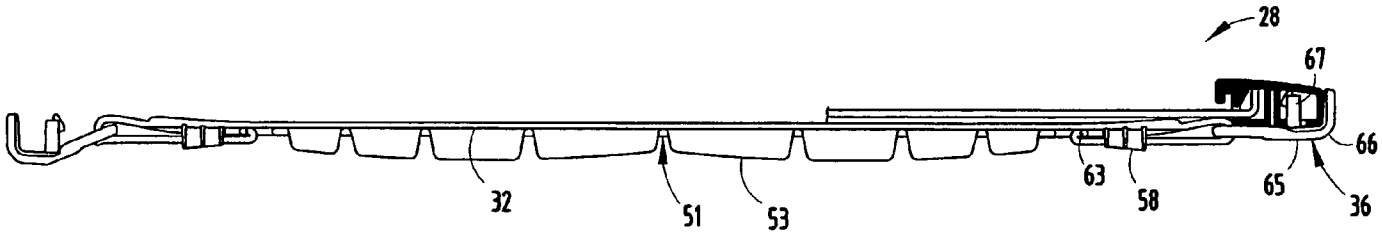
FIGS. 4–5 are top and front views of the lumbar device shown in FIG. 1, including fragments of the wire resilient members and side frame members of the back support.
Figure 5:
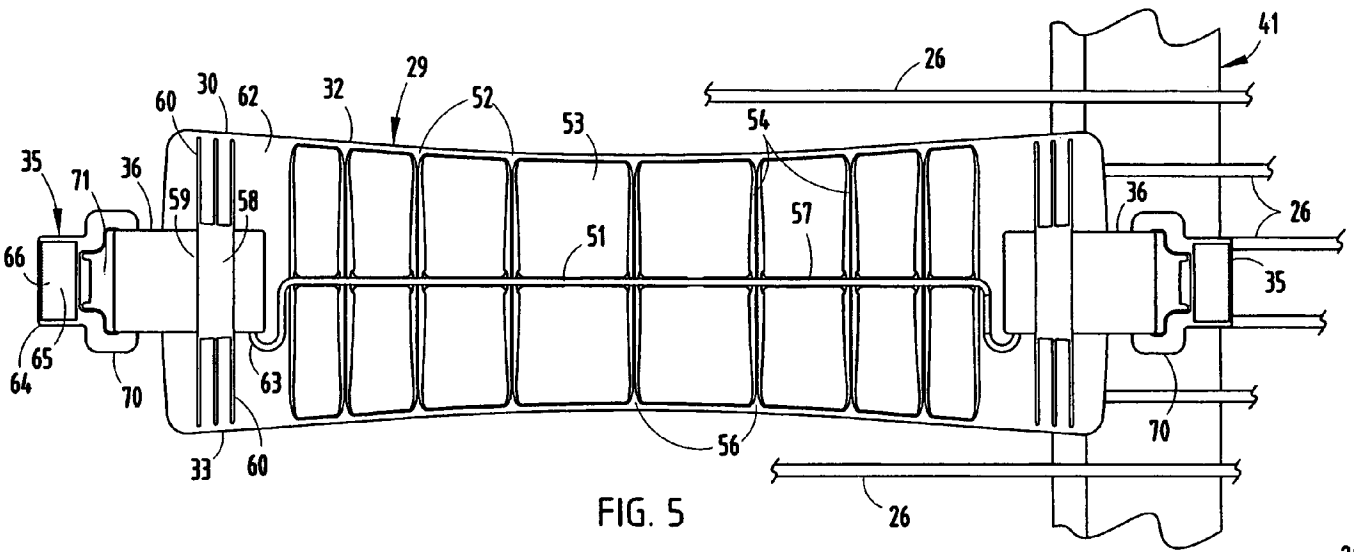
Figure 6:
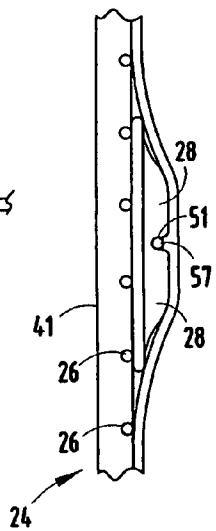
FIG. 6 is a cross section taken along line VI—VI in FIG. 7.
Figure 7:
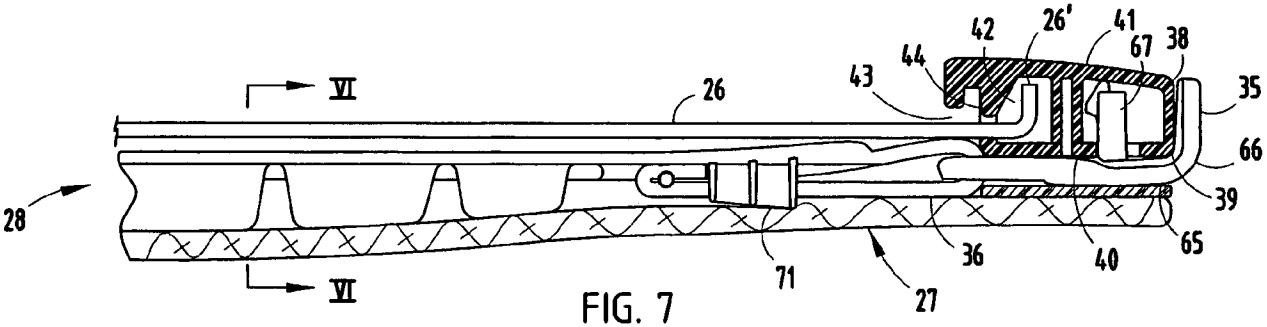
FIG. 7 is a cross section taken horizontally through the back at a location above the lumbar device in FIG. 1 and looking downwardly.

It is contemplated that the present cover 27 (FIG. 8) can be a variety of different materials for covering the perimeter frame 24 and resilient members 26. Notably, the resilient members 26 are sufficiently comfortable, such that it is not necessary that the cover 27 include a cushion or compressible material. However, the illustrated cover 27 includes a three-dimensional fabric known as a "technical material". The illustrated cover 27 includes first and second layers of woven material separated by resilient strands that connect the first and second layers to provide a cushioning member that provides air flow and that is recyclable. It is also contemplated that the cover 27 can be a subassembly of a foam cushion and fabric upholstery. A stiffener 46 (FIG. 2) is attached to a back surface of the cover 27, and includes side strips 47 that support and stabilize the edges of the cover 27. The stiffener 46 also includes top and bottom strips (not specifically shown) that form a perimeter around the entire cover 27 for stabilizing the cover 27. The top and bottom edges of the cover 27 are attached to the perimeter frame 24. This can be accomplished in a number of different ways. In the illustrated arrangement, a hooked ridge 48 (FIG. 2A) is attached to an edge of the cover 27, and is tucked into a mating channel 49 along an upper edge 50 of the perimeter frame 24 with a "zip lock" like action. A similar connection is provided at a bottom of the cover 27. The present description is sufficient for a person of ordinary skill to understand the present invention, but it is noted that the details of the function and operation of the cover attachment is described in more detail in the application Ser. No. 10/792,309 incorporated herein by reference above.

The lumber device 28 (FIG. 3) includes the body 29, and a wire 51 that connects fabric elastic loops 36 and handles 35 to the body 29. Specifically, the body 29 has a bow-tie shape formed by a unitary thermoformed (or injection-molded) sheet with vertically-enlarged end sections 30 defining a dimension D1 and a vertically narrower middle (when viewed in plan view). The body 29 has narrow upper and lower edges 32 and 33 and a thick middle section when viewed in side view from its end. The upper and lower edges 32 and 33 of the end sections 30 are limited to the thickness of the sheet material such that they are thin and serve to wedgingly slip between the cover 27 and the resilient members 26 in a manner leading the middle over irregular surfaces between the resilient members 26. Further, the edges 32 and 33 are near to the perimeter frame 24 where they are best able to slip between the cover 27 and the perimeter frame 24, even if a seated user is leaning against the back.

The body 29 (FIG. 3) is molded to have first wall portions 52 formed to define a first surface and second wall portions 53 formed to define a second surface. Third wall portions 54 extend between the first and second wall portions 52 and 53 to define space therebetween. The wall portions 53 and 54 form cube-shaped hollow blocks that look much like an ice cube tray (though they are triangularly shaped when viewed from an end). The hollow blocks have sufficient strength to maintain their shape when compressed, with the wall portions 52 being a base layer that is relatively flat. The areas between the blocks define vertical and horizontal grooves 56 and 57 that are relatively flexible since they lack a three-dimensional shape. Thus, while the body 29 is able to create space between the cover 27 and the resilient members 24, the body 29 is also flexible and able to conform to any shape defined by the plurality of resilient members 24. By this arrangement, the body 29 provides a desired shape change as the lumbar device is vertically adjusted, yet the lumbar device 28 supplements and complements the lumbar support force already provided by the resilient members 24 in a lumbar region of the back support 21 without destroying the beneficial comfortable support provided by the resilient members 24.

The outboard ends of the body 29 (FIG. 3) include a bridge flange 58 having a passageway 59 under the flange 58. The flange 58 is supported by reinforcing ribs 60 at each end. Fabric loops 36 extend through the passageway 59 under the flange 58. The horizontal groove 57 includes sufficient space for receiving a linear mid-section of the wire 51, and further includes at least two pair of opposing bumps 61 forming a resilient detent for frictionally snappingly engaging the wire 51 to hold it in position in the horizontal groove 57. There is a space 62 between the flange 58 and the end of the hollow blocks formed by wall portions 53–54, and the wire 51 includes back-and-forth "L" bends 63 shaped to fit into the space flat against the body 29.

The handles 35 (FIG. 3) each include an L-shaped grip 64 having a flat portion 65, and a perpendicular outer flange 66 for slidably engaging a front and outer surface of the side frame members 41. A protrusion 67 extends from the flat portion 65 inboard of the outer flange 66. The protrusion 67 slidably engages a slot 68 (FIG. 2) in a front of the side frame member 41 for guiding and also limiting the vertical adjustment of the handles 35. A loop 70 (FIG. 3) is formed on an inboard end of the grip 64, and includes a hole 71 through which the fabric loop 36 is positioned. The handles 35 are attached to the ends of the body 29 by the stretchable fabric loops 36, permitting the handles 35 to track along non-parallel side frame portions of the perimeter frame 24 during lumbar adjustment.

Assembly of the lumbar device 28 (FIG. 3) is very straightforward. A strip of fabric is extended through a hole 71 on each handle 35 and sewn to form the fabric loops 36. The fabric loops 36 are extended through the passageways 59 under flanges 58 on each end of the body 29, and the "L" bends 63 of the wire 51 are passed through the fabric loops 36. The wire 51 is then snapped into the groove 57, where it is retained in place by the detent bump 61. The lumbar device 28 is then positioned between the cover 27 and the back frame 24, with the handles 35 being located on each side and with the protrusions 67 operably engaging the slots 68 in the side frame sections 41. The elastic fabric loops 36 are stretchable and are stretched when assembled, such that they tension the handles 35 against the side frame sections 41 to provide friction to hold the lumbar device 28 in a selected adjusted position.

Figure 9:
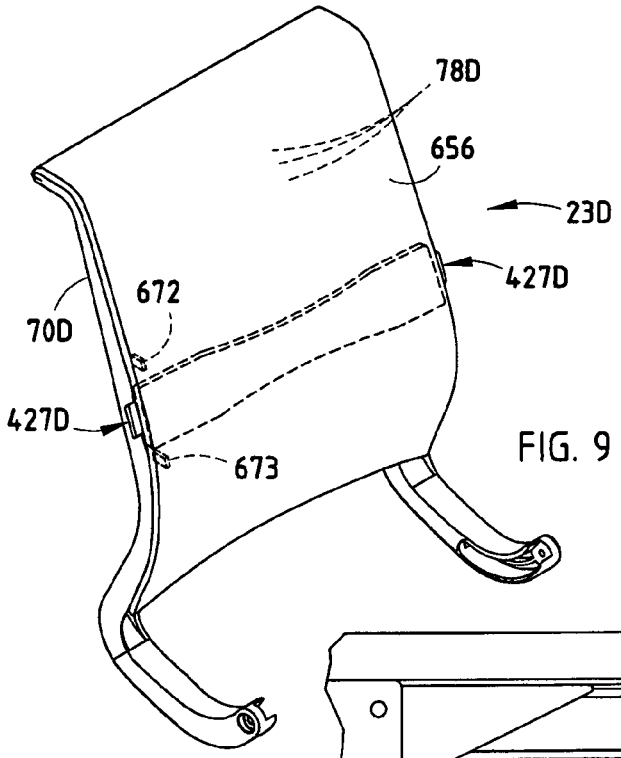
FIGS. 9 and 10 are perspective and rear views of the back of FIG. 1 but including a modified lumbar device.
Figure 10:
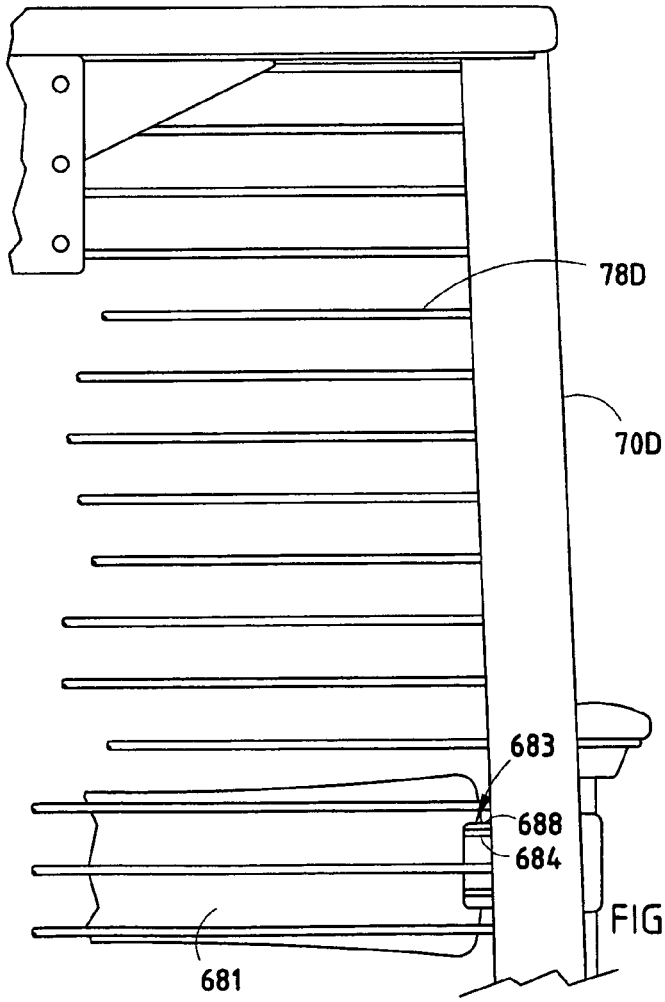
Figure 11:
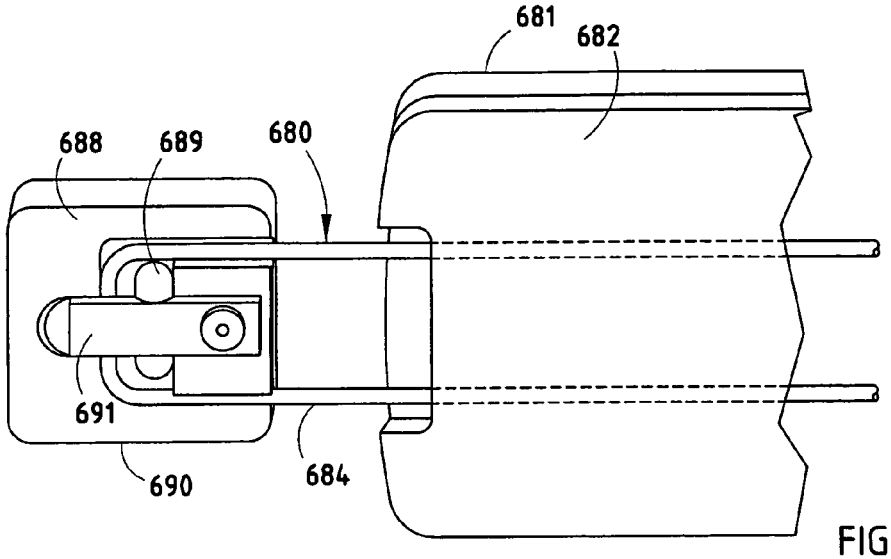
FIGS. 11–12 are an enlarged end section and an exploded perspective view of the lumbar device shown in FIGS. 9–10.
Figure 12:
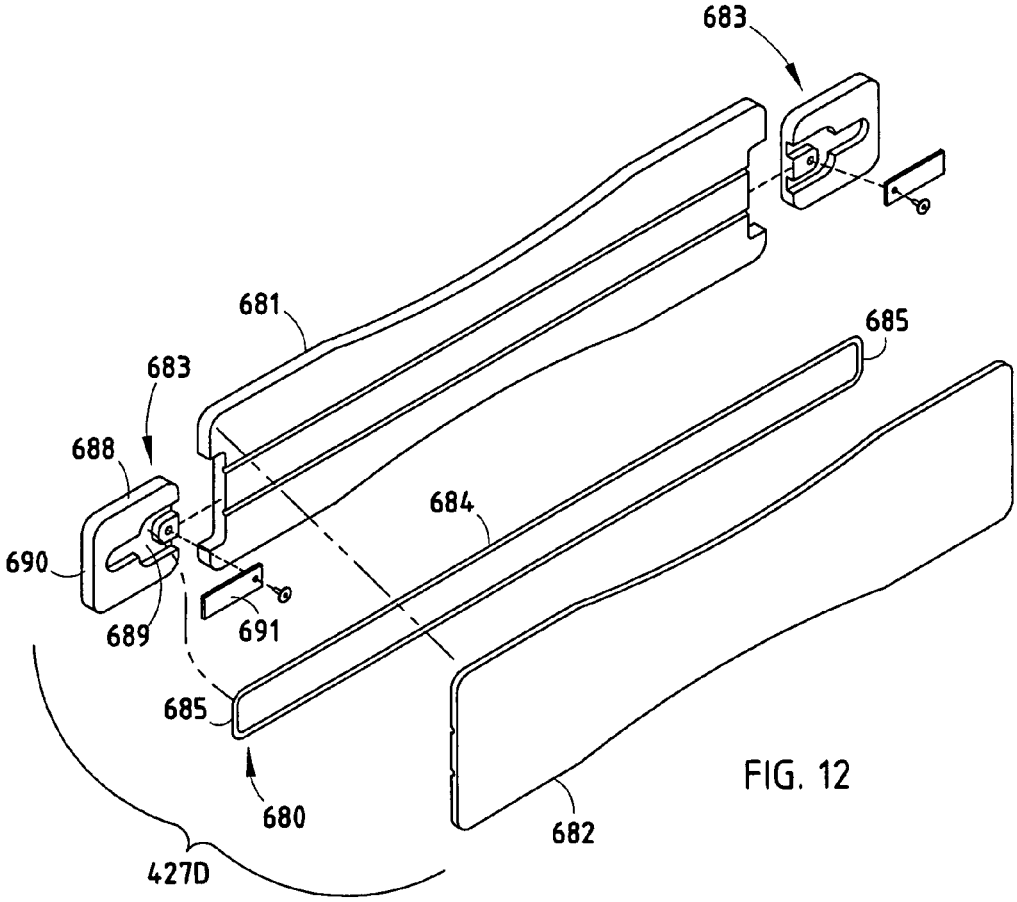

The lumbar device 427D (FIGS. 9–11) is positioned between the back covering 656 and the back frame 70D. The lumbar device 427D can be shifted vertically between the protrusions 672 and 673 for adjusting the lumbar support provided. The lumbar device 427D (FIG. 10) includes a wire 680, front and rear bow-tie-shaped thin panels 681 and 682, and opposing handles 683. The wire 680 is generally rectangular, and includes long resilient straight sections 684 and short ends 685. The thin panels 681 and 682 capture the wire 680 therebetween. It is contemplated that the thin panels 681 and 682 can be held together in different ways. For example, the two parts can be held together by separate fasteners (e.g. rivets, screws, mechanical interlocks, snaps), or can be held together by bonding techniques (e.g. heat staking, ultrasonic bonding, adhesive), or by other means known in the art. It is contemplated that the lumbar panels 681 and 682 can be extruded or molded. It is also contemplated that they can be made as a single part, with the panels 681 and 682 being held together with an integrally-molded living hinge and with a hook and tab feature opposite the living hinge for securement.

Unlike prior art lumbar devices, it is contemplated that the front and rear thin panels 681 and 682 are as thin as possible and are surprisingly flexible, so that the lumbar support comes from the active flexing of the wire 680, rather than from a stiff flat part. Thus, the lumbar support provided is very much like the support provided by the wires 78D in "comfort surface" of the back 23D. As a result, the lumbar support comes from the increase in force versus displacement curve provided (i.e. the wire 680 of the lumbar device supplements the wires 78D of the back 23D) . . . instead of the increased lumbar support coming only from a forced shape change in the lumbar area of the back 23D. Nonetheless, it is contemplated that increased lumbar support can come from both a lumbar shape change and also an increased lumbar support force curve.

The wire 680 is able to flex and move within and between the panels 681 and 682, and the ends 685 of the wire 680 extend outward from ends of the panels 681 and 682. Handles 683 include a thin body 688 with a U-shaped cavity 689 for receiving the ends 685. A handle 690 is attached to an end of components 680, 681, 682, and extends outward from them to form a grip to facilitate adjustment of the lumbar device 427D that can be grasped from a side of the chair 20D. The wire 680 can be snapped into position or a second tab or a clip 691 can be provided to loosely retain the wire 680 slidably within the U-shaped cavity 689. Advantageously, one or both sides of the lumbar device 427D can be adjusted, so that an optimal comfortable support can be obtained. The lumbar device 427D is held in place by the tension of the back covering 656, which, due to the curvature of the back, causes tension between the back covering 656 and the back frame 667.

It is contemplated that the wire loop 680 can be replaced with a flat strip of spring metal or leaf-spring-like plastic member. In fact, the entire lumbar wire 680 and "clam shell" covers 681, 682 could be replaced with a single molding or stamping, with its handles 42 being formed on or attached to ends of the lumbar device.

Figure 13:
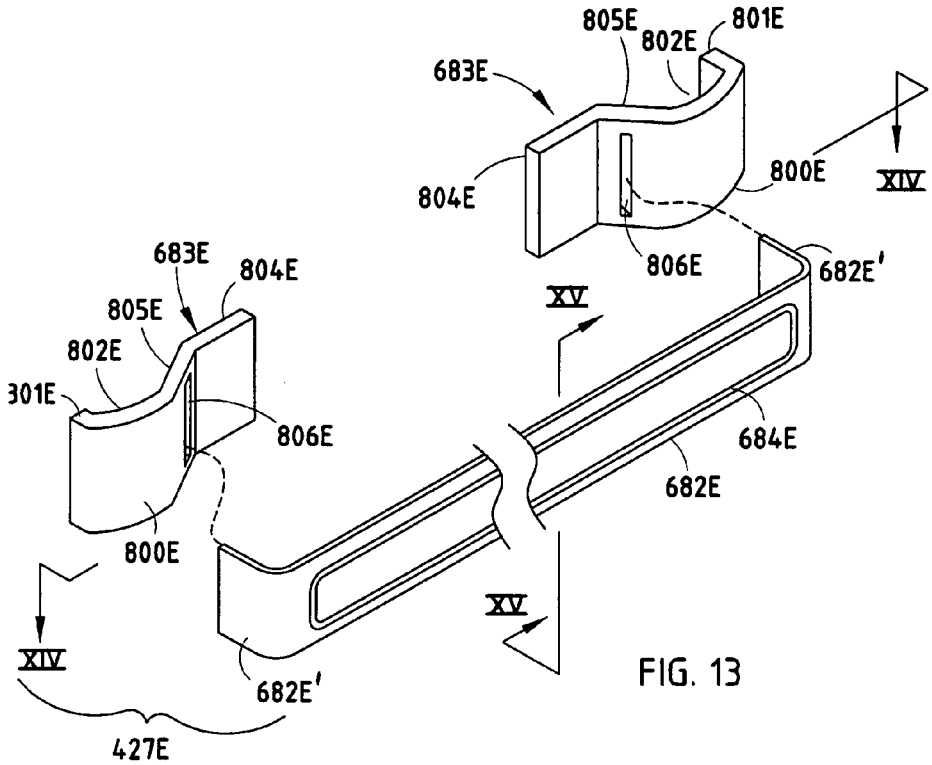
FIG. 13 is an exploded view of another modified lumbar device.
Figure 14:
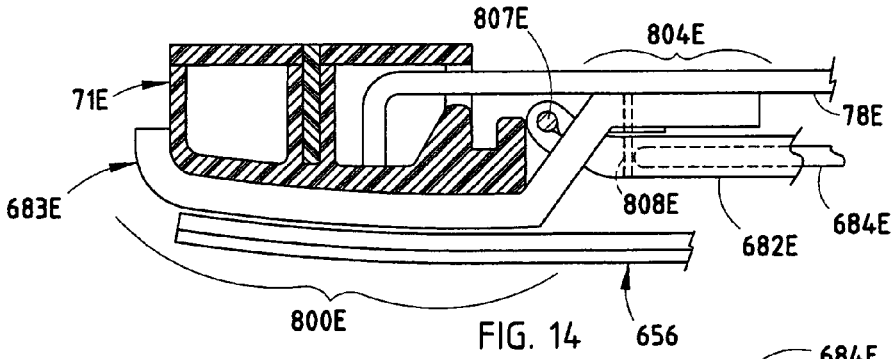
FIGS. 14–15 are cross sections taken along lines XIV—XIV and XV—XV in FIG. 13.
Figure 15:
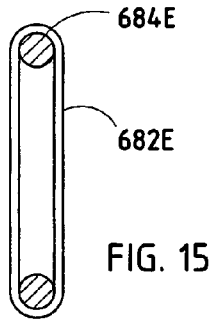

Another lumbar device 427E (FIGS. 13–15) includes a rectangular wire 684E positioned inside of a sock 682E of slightly-elastic material, such as slippery LYCRA® material. The sock material can be black, fabric-color, patterned, see-through, or translucent. Handles 683E are attached to ends 682E' of the sock 682E. The handles 683E include an outer end section 800E with a lip 801E forming a recess 802E that slidably engages a front surface of the back frame side sections 71E. The inboard end 804E is offset from an intermediate section 805E to form a shelf for supporting the end of the wire 684E that is co-planar with the outer end section 800E. An end 682E' of the sock 682E is fed through an aperture 806E in the intermediate section 805E. The end 682E' is doubled back and either looped around an anchor 807E or is secured (e.g. by stapling or fastener 808E) to the handle 683E.

The lumbar device 427E is positioned under the upholstery back covering and in front of the back frame side sections 71E, with the handles 683E slidably engaging the side section 71E. If the back frame side sections 71E are non-parallel, the sock 682E stretches (or elastically shrinks) to compensate as the lumbar device 427E is moved vertically. The slipperiness of the sock 682E helps the lumbar device 427E slip up and over each successive back wire 78E as the lumbar device 427E is vertically adjusted. The long parallel sections of the wire 684E can be (but do not necessarily need to be) bent to form a slightly bowtie-shaped arrangement, which shape also helps slip up and over each successive wire 78E.

It is to be understood that variations and modifications can be made on the aforementioned structure without departing from the concepts of the present invention, and further it is to be understood that such concepts are intended to be covered by the following claims unless these claims by their language expressly state otherwise.

We claim:

1. A seating unit comprising:

a back support;

a back cover located on a front surface of the back support but separable therefrom at least in a lumbar area of the back cover; and a lumbar device adjustably positioned between the back support and the back cover, the lumbar device including a shape-changing member for changing a shape of the lumbar area during vertical adjustment, and further including handles that track along edges of the back support and still further including a nonmetal stretchable elastic material that connects the handles to respective ends of the shape-changing member, whereby vertical movement of the lumbar device causes a shape change of the back cover for providing improved lumbar support to a seated user.

2. The seating unit defined in claim 1, wherein the lumber device includes a wire attached to the shape-changing member and that extends horizontally across the shape-changing member.

3. The seating unit defined in claim 2, wherein the third wall portions define a groove for receiving the wire and further include friction tabs that snap-attach the wire to the shape-changing member.

4. The seating unit defined in claim 3, wherein the shape-changing member comprises a thermoformed panel.

5. The seating unit defined in claim 4, including handles that are operably connected by stretchable material to ends of the shape-changing member.

6. The seating unit defined in claim 5, wherein the handles slidably engage and track non-parallel edges of the back support.

7. A seating unit comprising:

a back support;

a back cover located on a front surface of the back support but separable therefrom at least in a lumbar area of the back cover; and a lumbar device adjustably positioned between the back support and the back cover, the lumbar device including a longitudinally, non-stretchable flexible panel configured to slidingly engage the front surface of the back support and a rear surface of the back cover, respectively, and still further including handles that track along edges of the back support and yet still further including stretchable material that connects the handles to respective ends of the the flexible panel, whereby vertical movement of the lumbar device causes a shape change of the back cover for providing improved lumbar support to a seated user.

8. The seating unit defined in claim 7, wherein the flexible panel comprises a thermoformed panel.

9. A seating unit comprising:

a back support including side frame members and horizontally extending resilient members spaced in a vertical direction in a lumbar area of the back support;

a back cover shaped to cover at least a front of the side frame members; and a lumbar device positioned between the back cover and the resilient members for affecting lumbar support, the lumbar device having a body with end sections connected by a middle section, upper and lower edges of the vertical end sections being relatively thin and defining a larger vertical dimension than the middle section forming wedges and shaped to guide the upper and lower edges of the middle section over the resilient members as the lumbar device is vertically adjusted.

10. The seating unit defined in claim 9, including handles that slidably engage and track non-parallel edges of the back support as the lumbar device is vertically adjusted.

11. The seating unit defined in claim 10, including elastic stretchable sections connecting the handles to the body.

12. The lumbar device defined in claim 9, wherein the resilient members comprise wires.

13. The seating unit defined in claim 9, wherein the body includes upper and lower edges that are curvilinear to define a bow tie shape.

14. The seating unit defined in claim 13, wherein the upper and lower edges are relatively thin and areas therebetween have a thicker dimension.

15. The seating unit defined in claim 9, wherein the body is a flexible plastic panel.

16. The seating unit defined in claim 15, wherein the body is thermoformed to include first walls on a front side and second walls on a rear side and third walls interconnecting the first and second walls, the third walls maintaining a spacing of the first and second walls.

17. The seating unit defined in claim 16, wherein the body includes a groove, and wherein the wire snaps into the groove.

18. The seating unit defined in claim 9, including handles attached to ends of the body.

19. The seating unit defined in claim 18, wherein the handles each includes a grip that engages one of the side frame members and further including stretchable elastic material that connects each grip to an end of the body.

20. The seating unit defined in claim 19, wherein the elastic material is stretched and causes the handle to frictionally engage the side frame members in a manner holding the lumbar device in a selected position.

21. The seating unit defined in claim 9, wherein the lumbar device is visible in the back support.

22. The seating unit defined in claim 9, wherein the lumbar device is visible between the resilient members.

23. The seating unit defined in claim 9, including a handle attached to each end of the body that engages a mating slot in the side frame members.

24. The seating unit defined in claim 9, wherein the body is symmetrical about a vertical centerline and a horizontal centerline.

* * * * *